US006719547B2

(12) United States Patent
Heizer

(10) Patent No.: US 6,719,547 B2
(45) Date of Patent: Apr. 13, 2004

(54) OFFSET THREAD SCREW ROTOR DEVICE

(75) Inventor: Charles K. Heizer, St. Louis, MO (US)

(73) Assignee: Imperial Research LLC, Peveley, MO (US)

( * ) Notice: Subject to any disclaimer, the term of this patent is extended or adjusted under 35 U.S.C. 154(b) by 0 days.

(21) Appl. No.: 10/283,421

(22) Filed: Oct. 29, 2002

(65) Prior Publication Data

US 2003/0077198 A1 Apr. 24, 2003

Related U.S. Application Data

(63) Continuation-in-part of application No. 10/013,747, filed on Oct. 19, 2001, now Pat. No. 6,599,112.

(51) Int. Cl.[7] ..... F01C 1/16
(52) U.S. Cl. ..... 418/201.1; 418/201.3
(58) Field of Search ..... 418/201.1, 201.3

(56) References Cited

U.S. PATENT DOCUMENTS

| | | | | |
|---|---|---|---|---|
| 726,969 | A | | 5/1903 | Motsinger |
| 1,218,602 | A | | 3/1917 | Holdaway |
| 1,698,802 | A | | 1/1929 | Montelius |
| 1,751,703 | A | | 3/1930 | Long |
| 2,095,167 | A | | 10/1937 | Burghauser |
| 2,321,696 | A | | 6/1943 | Montelius |
| 2,693,762 | A | | 11/1954 | Sennet |
| 2,908,226 | A | | 10/1959 | Rich et al. |
| 2,931,308 | A | * | 4/1960 | Luthi ..... 418/201.1 |
| 3,138,110 | A | * | 6/1964 | Whitfield ..... 418/201.3 |
| 3,170,566 | A | * | 2/1965 | Zimmermann ..... 418/201.1 |
| 3,245,612 | A | | 4/1966 | Nilsson et al. |
| 3,275,226 | A | | 9/1966 | Whitfield |
| 3,282,495 | A | | 11/1966 | Walls |
| 3,582,244 | A | | 6/1971 | Siclari |
| 3,597,133 | A | | 8/1971 | Zeltvogel |
| 3,623,830 | A | | 11/1971 | Wildhaber |
| 3,693,601 | A | | 9/1972 | Sauder |
| 3,787,154 | A | | 1/1974 | Edstrom |
| 3,809,510 | A | | 5/1974 | Gregerson et al. |
| 3,814,557 | A | | 6/1974 | Volz |
| 3,841,805 | A | * | 10/1974 | Zalis ..... 418/201.1 |
| 4,017,223 | A | | 4/1977 | Blackwell |
| 4,028,025 | A | | 6/1977 | Lonnebring |
| 4,028,026 | A | | 6/1977 | Menssen |
| 4,145,168 | A | | 3/1979 | Smith, Jr. et al. |
| 4,242,067 | A | | 12/1980 | Segerström |
| 4,291,547 | A | | 9/1981 | Leo |
| 4,311,021 | A | | 1/1982 | Leo |
| 4,328,684 | A | | 5/1982 | Leo |
| 4,412,796 | A | | 11/1983 | Bowman |
| 4,547,135 | A | | 10/1985 | Noel et al. |
| 4,588,363 | A | | 5/1986 | Carre et al. |
| 4,964,790 | A | | 10/1990 | Scott |
| 5,120,208 | A | | 6/1992 | Toyoshima et al. |
| 5,911,743 | A | | 6/1999 | Shaw |
| 6,185,956 | B1 | | 2/2001 | Brasz |
| 6,193,491 | B1 | | 2/2001 | Cheng |
| 6,244,844 | B1 | | 6/2001 | Diaz |

FOREIGN PATENT DOCUMENTS

| | | | |
|---|---|---|---|
| JP | 402298687 | A | 12/1990 |

* cited by examiner

*Primary Examiner*—Thomas Denion
*Assistant Examiner*—Theresa Trieu
(74) *Attorney, Agent, or Firm*—Dennis J M Donahue, III; Grant D. Kang; Husch & Eppenberger LLC

(57) ABSTRACT

A screw rotor device has a housing with an inlet port and an outlet port, a male rotor, and a female rotor. The male rotor has a pair of helical threads with a phase-offset aspect, and the female rotor has a corresponding pair of helical grooves. The female rotor counter-rotates with respect to the male rotor and each of the helical grooves respectively intermeshes in phase with each of the helical threads. The phase-offset aspect of the helical threads is formed by a pair of teeth bounding a toothless sector. The arc angle of the toothless sector is a least twice the arc angle that subtends either one of the teeth. The helical grooves have a radially narrowing axial width at the periphery of the female rotor. The male and female rotors may include a buttress thread profile and may be limited in length to a single pitch.

20 Claims, 6 Drawing Sheets

OFFSET THREAD SCREW ROTOR DEVICE

CROSS-REFERENCE TO RELATED APPLICATIONS

This application is related to co-pending U.S. application Ser. No. 10/283,422, filed on Oct. 29, 2002, and is a continuation-in-part of U.S. application Ser. No. 10/013,747, filed on Oct. 19, 2001 (U.S. Pat. No. 6,599,112).

STATEMENT REGARDING FEDERALLY SPONSORED RESEARCH OR DEVELOPMENT

Not Applicable.

BACKGROUND OF THE INVENTION

1. FIELD OF THE INVENTION

This invention relates generally to rotor devices and, more particularly to screw rotors.

2. DESCRIPTION OF RELATED ART

Screw rotors are generally known to be used in compressors, expanders, and pumps. For each of these applications, a pair of screw rotors have helical threads and grooves that intermesh with each other in a housing. For an expander, a pressurized gaseous working fluid enters the rotors, expands into the volume as work is taken out from at least one of the rotors, and is discharged at a lower pressure. For a compressor, work is put into at least one of the rotors to compress the gaseous working fluid. Similarly, for a pump, work is put into at least one of the rotors to pump the liquid. The working fluid, either gas or liquid, enters through an inlet in the housing, is positively displaced within the housing as the rotors counter-rotate, and exits through an outlet in the housing.

The rotor profiles define sealing surfaces between the rotors themselves between the rotors and the housing, thereby sealing a volume for the working fluid in the housing. The profiles are traditionally designed to reduce leakage between the sealing surfaces, and special attention is given to the interface between the rotors where the threads and grooves of one rotor respectively intermesh with the grooves and threads of the other rotor. The meshing interface between rotors must be designed such that the threads do not lock-up in the grooves, and this has typically resulted in profile designs similar to gears, having radially widening grooves and tightly spaced involute threads around the circumference of the rotors.

However, an involute for a gear tooth is primarily designed for strength and to prevent lock-up as teeth mesh with each other and are not necessarily optimum for the circumferential sealing of rotors within a housing. As discussed above, threads must provide seals between the rotors and the walls of the housing and between the rotors themselves, and there is a transition from sealing around the circumference of the housing to sealing between the rotors. In this transition, a gap is formed between the meshing threads and the housing, causing leaks of the working fluid through the gap in the sealing surfaces and resulting in less efficiency in the rotor system. A number of arcuate profile designs improve the seal between rotors and may reduce the gap in this transition region but these profiles still retain the characteristic gear profile with tightly spaced teeth around the circumference, resulting in a number of gaps in the transition region that are respectively produced by each of the threads. Some pumps minimize the number of threads and grooves and may only have a single acme thread for each of the rotors, but these threads have a wide profile around the circumferences of the rotors and generally result in larger gaps in the transition region.

BRIEF SUMMARY OF THE INVENTION

It is in view of the above problems that the present invention was developed. The invention features a screw rotor device with phase-offset helical threads on a male rotor that mesh with the identical number of corresponding phase-offset helical grooves on a female rotor. Another feature of the invention is the cut-back concave profile of the helical groove and the corresponding shape of the cut-in convex profile that meshes with the cut-back concave profile of the helical groove. The cut-back concave profile corresponds with a helical groove having a radially narrowing axial width at the periphery of the female rotor. Yet another feature of the invention is the buttress thread profile of the helical threads and the helical grooves. Additionally, another aspect of the invention is limiting the maximum length of the rotors to a single pitch of the helical thread and groove. The features of the invention result in an advantage of improved efficiency of the screw rotor device.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE INVENTION

Figure 1:
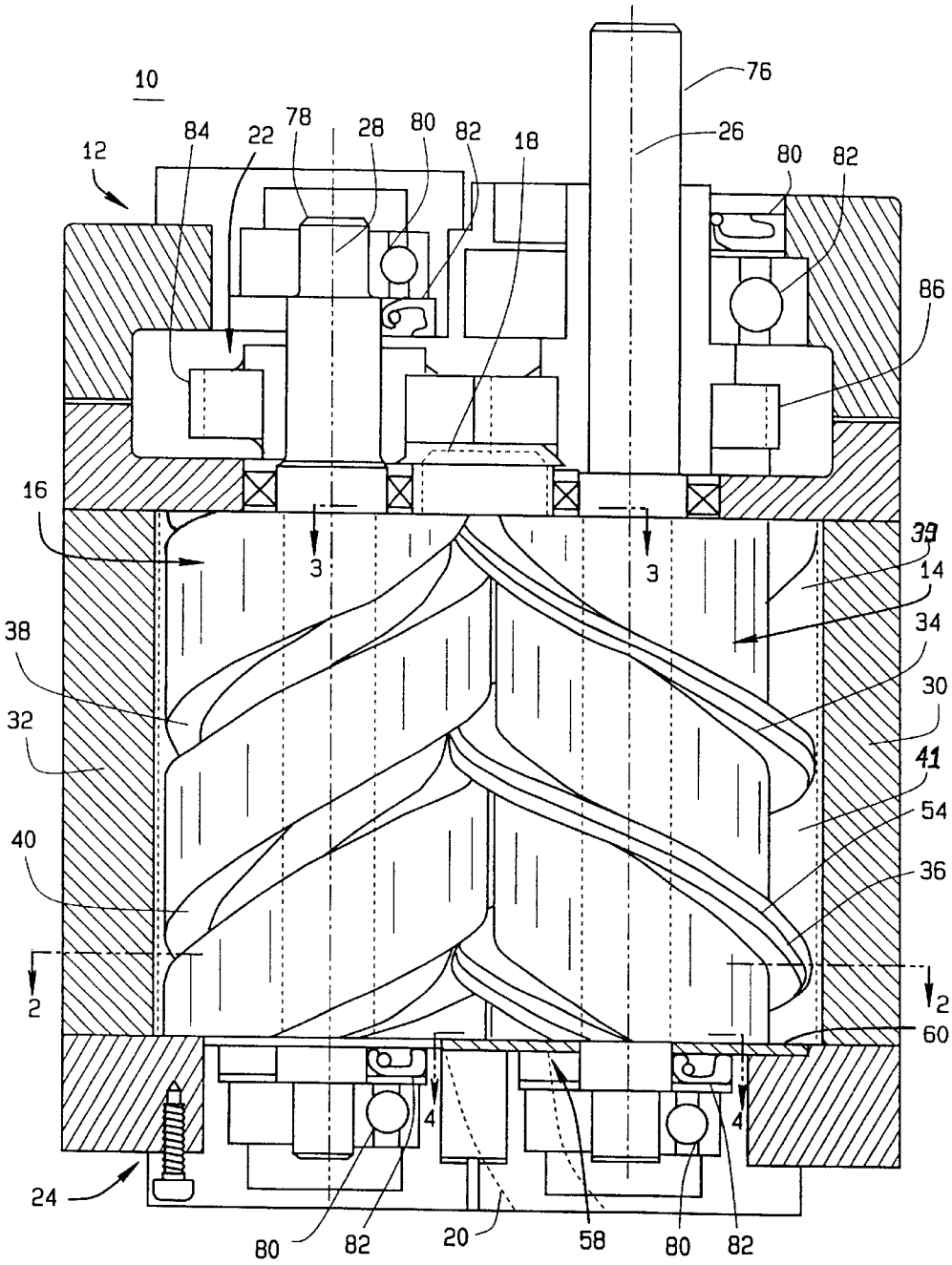
FIG. 1 illustrates an axial cross-sectional view of a screw rotor device according to the present invention.

Referring to the accompanying drawings in which like reference numbers indicate like elements, FIG. 1 illustrates an axial cross-sectional schematic view of a screw rotor device 10. The screw rotor device 10 generally includes a housing 12, a male rotor 14, and a female rotor 16. The housing 12 has an inlet port 18 and an outlet port 20. The inlet port 18 is preferably located at the gearing end 22 of the housing 12, and the outlet port 20 is located at the opposite end 24 of the housing 12. The male rotor 14 and female rotor 16 respectively rotate about a pair of substantially parallel axes 26, 28 within a pair of cylindrical bores 30, 32 extending between ends 22, 24.

In the preferred embodiment, the male rotor 14 has at least one pair of helical threads 34, 36, and the female rotor 16 has a corresponding pair of helical grooves 38, 40. The female rotor 16 counter-rotates with respect to the male rotor 14 and each of the helical grooves 38, 40 respectively intermeshes in phase with each of the helical threads 34, 36. In this manner, the working fluid flows through the inlet port 18 and into the screw rotor device 10 in the spaces 39, 41 bounded by each of the helical threads 34, 36, the female rotor 16, and the cylindrical bore 30 around the male rotor 14. It will be appreciated that the helical grooves 38, 40 also define spaces bounding the working fluid. The spaces 39, 41 are closed off from the inlet port 18 as the helical threads 34, 36 and helical grooves 38, 40 intermesh at the inlet port 18. As the female rotor 16 and the male rotor 14 continue to counter-rotate, the working fluid is positively displaced toward the outlet port 20.

Figure 2A:
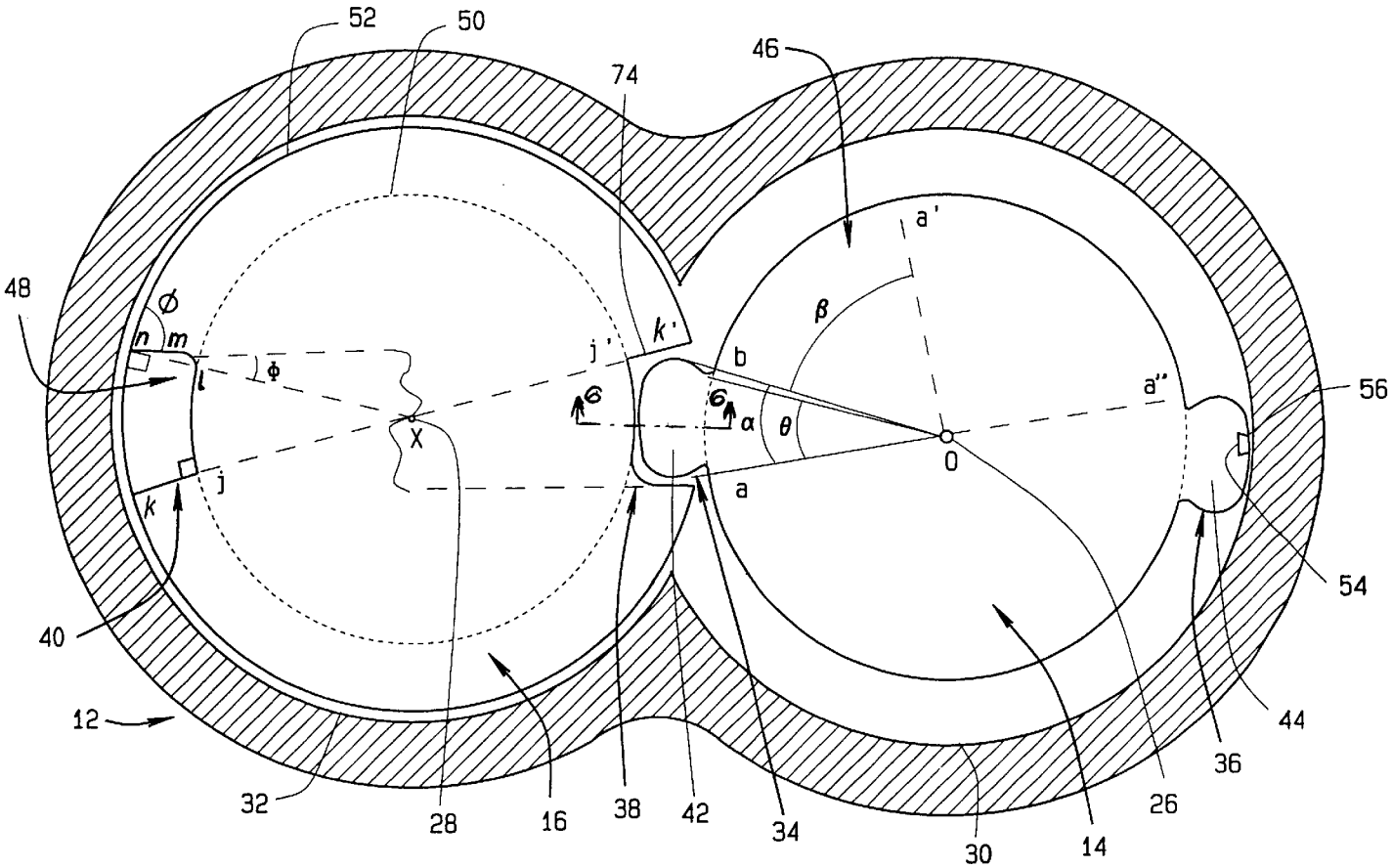
FIG. 2A illustrates a detailed cross-sectional view of one embodiment of the screw rotor device taken along the line 2—2 of FIG. 1.
Figure 2B:
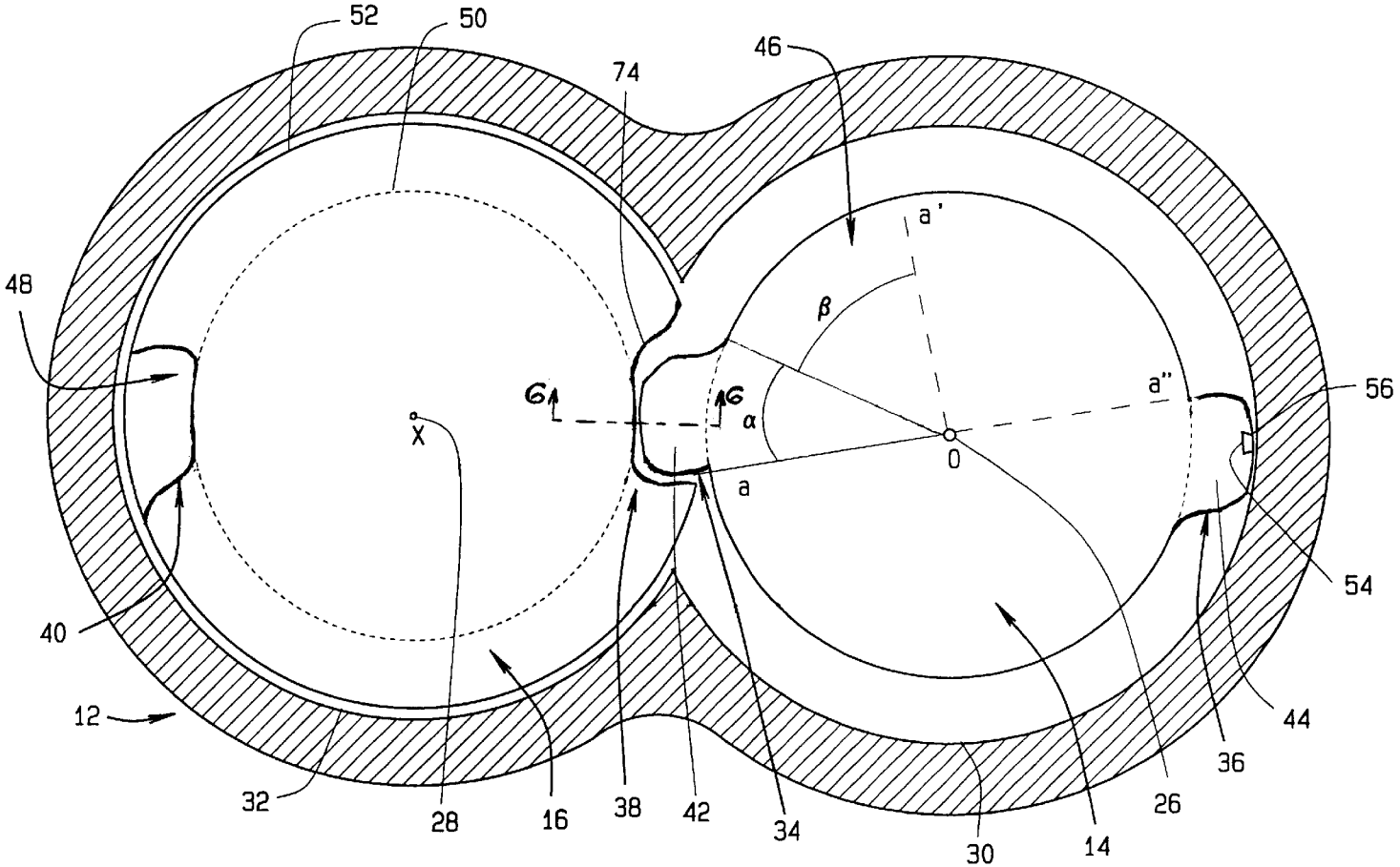
FIG. 2B illustrates a detailed cross-sectional view of another embodiment of the screw rotor device taken along the line 2—2 of FIG. 1.
Figure 3:
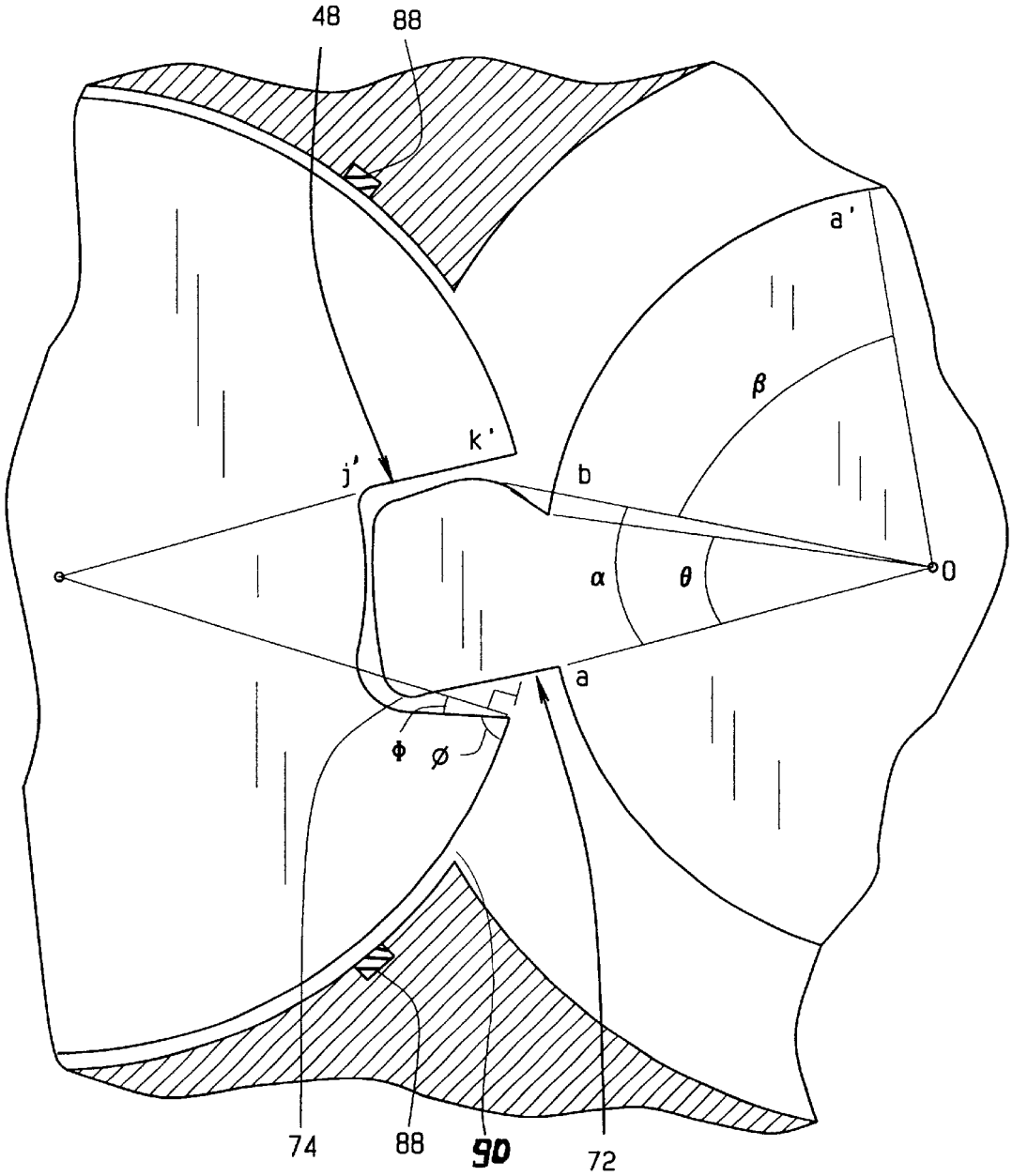
FIG. 3 illustrates a detailed cross-sectional view of the screw rotor device taken along line 3—3 of FIG. 1.

The pair of helical threads 34, 36 have a phase-offset aspect that is particularly described in reference to FIGS. 2A, 2B and 3 which show the cross-sectional profile of the screw rotor device through line 2—2, the two-dimensional profile being represented in the plane perpendicular to the axes of rotation 26, 28. The phase-offset aspect is also discussed below in reference to FIG. 7A. The cross-section of the pair of helical threads 34, 36 includes a pair of corresponding teeth 42, 44 bounding a toothless sector 46. The phase-offset of the helical threads 34, 36 is defined by the arc angle $\beta$ subtending the toothless sector 46 which depends on the arc angle $\alpha$ of either one of the teeth 42, 44. In particular, for phase-offset helical threads, the toothless sector 46 must have an arc angle $\beta$ that is at least twice the arc angle $\alpha$ subtending either one of the teeth 42, 44. The phase-offset relationship between arc angle $\beta$ and arc angle $\alpha$ is particularly defined by equation (1) below:

$$\text{Arc Angle } \beta \geqq 2^* \text{ Arc Angle } \alpha \tag{1}$$

As illustrated in FIGS. 2A and 2B, the angle between ray segment oa and ray segment ob, subtending tooth 42, is arc angle $\alpha$. According to the phase-offset definition provided above, arc angle $\beta$ of the toothless sector 46 must extend from ray segment ob to at least to ray segment oa', which would correspond to twice the arc of arc angle $\alpha$, the minimum phase-offset multiplier being two (2) in equation 1. In the preferred embodiment, the arc angle $\beta$ of the toothless sector 46 extends approximately five times arc angle $\alpha$ to ray segment oa", corresponding to a phase-offset multiplier of five (5). Accordingly, another two additional teeth could be potentially fit on opposite sides of the male rotor 14 between the teeth 42, 44 while still satisfying the phase-offset relationship with the minimum phase-offset multiplier of two (2).

For balancing the male rotor 14, it is preferable to have equal radial spacing of the teeth. An even number of teeth is not necessary because an odd number of teeth could also be equally spaced around male rotor 14. Additionally, the number of teeth that can fit around male rotor 14 is not particularly limited by the preferred embodiment. Generally, arc angle $\beta$ is proportionally greater than arc angle $\alpha$ according to the phase-offset multiplier. Accordingly, arc angle $\beta$ of the toothless sector 46 can decrease proportionally to any decrease in the arc angle $\alpha$ of the teeth 42, 44, thereby allowing more teeth to be added to male rotor 14 while maintaining the phase-offset relationship. Whatever the number of teeth on the male rotor 14, the female rotor has a corresponding number of helical grooves. Accordingly, the helical grooves 38, 40 have a phase-offset aspect corresponding to that of the helical threads 34, 36. Therefore, the female rotor has the same number of helical grooves 38, 40 as the number of helical threads 34, 36 on the male rotor, and the helix angle of the helical grooves 38, 40 is opposite-handed from the helix angle of the helical threads 34, 36.

In the preferred embodiment, each of the helical grooves 38, 40 preferably has a cut-back concave profile 48 and corresponding radially narrowing axial, widths from locations between the minor diameter 50 and the major diameter 52 towards the major diameter 52 at the periphery of the female rotor 16. The cut-back concave profile 48 includes line segment jk radially extending between the minor diameter 50 and the major diameter 52 on a ray from axis 28, line segment lm radially extending between the minor diameter 50 and the major diameter 52, and a minor diameter arc lj circumferentially extending between the line segments jk, lm. Line segment jk is substantially perpendicular to major diameter 52 at the periphery of the female rotor 16, and line segment lmn preferably has a radius lm combined with a straight segment mn. In particular, radius lm is between straight segment mn and minor diameter arc lj and straight segment mn intersects major diameter 52 at an acute exterior angle $\Phi$, resulting in a cut-back angle $\Phi$ defined by equation (2) below.

$$\text{Cut-Back Angle } \Phi = \text{Right Angle } (90^\circ) - \text{Exterior Angle} \phi, \tag{2}$$

The cut-back angle $\Phi$ and the substantially perpendicular angle at opposite sides of the cut-back concave profile 48 result in the radial narrowing axial width at the periphery of the female rotor 16. In the preferred embodiment, the helical grooves 38, 40 are opposite from each other about axis 28 such that line segment jk for each of the pair of helical grooves 38, 40 is directly in-line with each other through axis 28. Accordingly, in the preferred embodiment, line segment kjxj'k' is straight.

Figure 4:
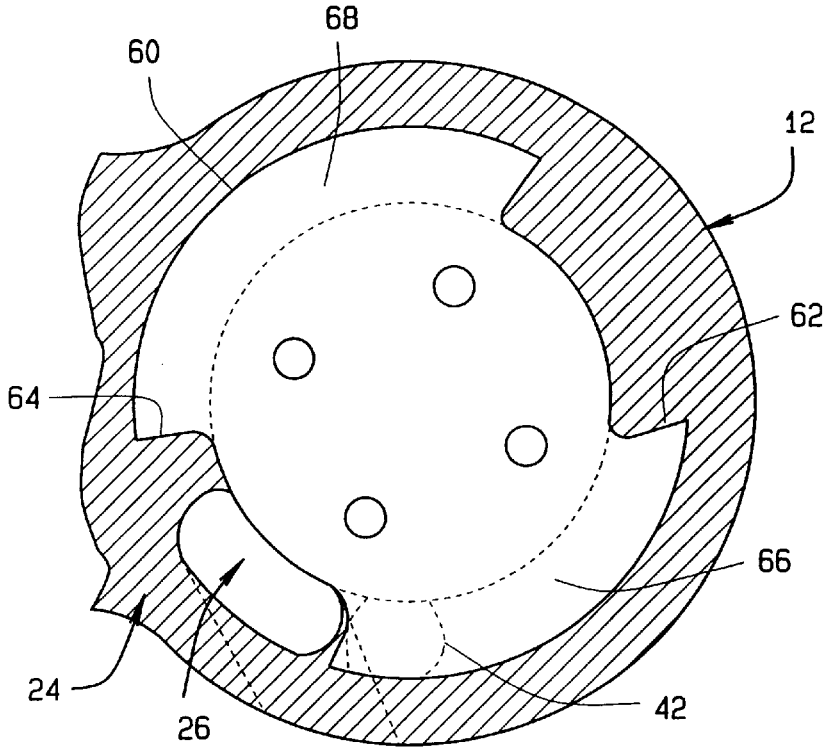
FIG. 4 illustrates a cross-sectional view of the screw rotor device taken along line 4—4 of FIG. 1.

In the preferred embodiment of the present invention, the screw rotor device 10 operates as a screw compressor on a gaseous working fluid. Each of the helical threads 34, 36 may also include a distal labyrinth seal 54, and a sealant strip 56 may also be wedged within the distal labyrinth seal 54. The distal labyrinth seal 54 may also be formed by a number of striations at the tip of the helical threads (not shown). When operating as a screw compressor, the screw rotor device 10 preferably includes a valve 58 operatively communicating with the outlet port 20. In the preferred embodiment, the valve 58 is a pressure timing plate 60 attached to and rotating with the male rotor 14 and is located between the male rotor 14 and the outlet port 20. As particularly illustrated in FIG. 4, the pressure timing plate 60 has a pair of cutouts 62, 64 that sequentially open to the outlet port 20. Between the cutouts 62, 64, the pressure timing plate 60 forms additional boundaries 66, 68 to the spaces 39, 41 respectively. As the male rotor 14 counter-rotates with the female rotor 16, boundaries 66, 68 cause the volume in the spaces 39, 41 to decrease and the pressure of the working fluid increases. Then, as the cutouts 62, 64 respectively pass over the outlet port 20, the pressurized working fluid is forced out of the spaces 39, 41 and the spaces 39, 41 continue to decrease in volume until the bottom of the respective helical threads 34, 36 pass over the outlet port.

Figure 5:
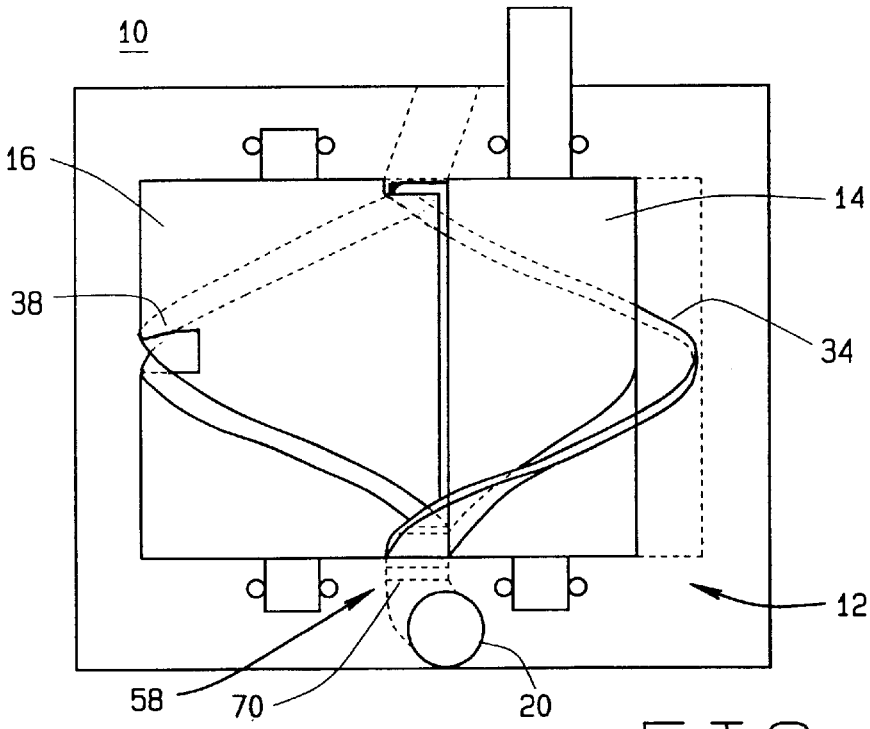
FIG. 5 illustrates a schematic diagram of an alternative embodiment of the invention.

FIG. 5 illustrates an alternative embodiment of the screw rotor device 10 that only has one helical thread 34 intermeshing with the corresponding helical groove 38 and preferably has a valve 58 at the outlet port 20. As illustrated in FIG. 5, the valve 58 can be a reed valve 70 attached to the housing 12. In this embodiment, weights may be added to the male rotor 14 and the female rotor 16 for balancing. The helical groove 38 can have the cut-back concave profile 48 described above, and the male rotor 14 again counter-rotates with respect to the female rotor 16.

The alternative embodiment also illustrates another aspect of the screw rotor device 10 invention. In this embodiment, the length of the screw rotor device 10 is limited to a single pitch of the helical thread 34 and groove 38. The pitch of a screw is generally defined as the distance from any point on a screw thread to a corresponding point on the next thread, measured parallel to the axis and on the same side of the axis. The particular screw rotor device 10 illustrated in FIG. 5 has a single thread 34 and corresponding groove 38. Therefore, a single pitch of the 34 and groove 38 requires a complete 360° helical twist of the thread 34 and corresponding groove 38. The present invention is directed toward screw rotor devices 10 having the identical number of threads and grooves (N), and the helical twist required to provide the single pitch is merely defined by the number of threads and grooves (N=1, 2, 3, 4, . . . ) according to equation (3) below.

$$\text{Single Pitch Helical Twist}=360°/N \quad (3)$$

Figure 7A:
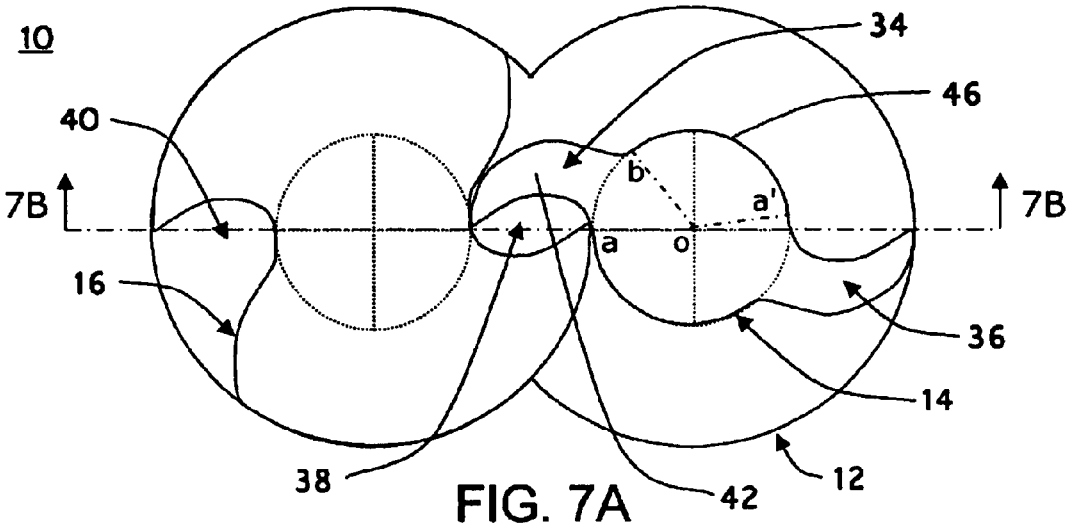
FIG. 7A illustrates an axial cross-sectional view of another alternative embodiment of the screw rotor device according to the present invention
Figure 7B:
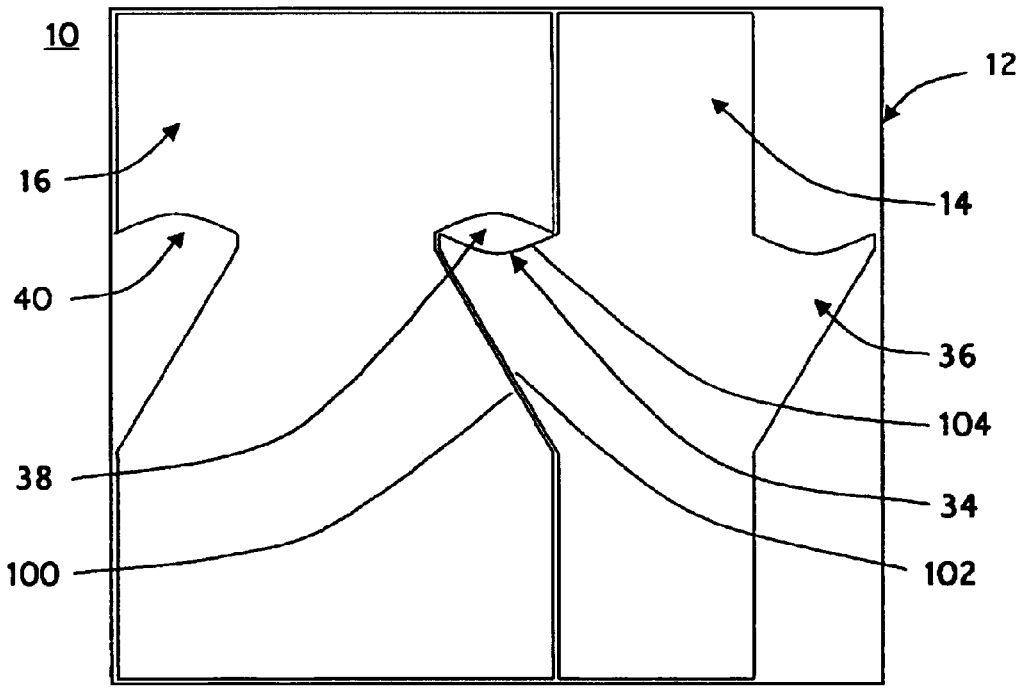
FIG. 7B illustrates a lengthwise cross-sectional view of the screw rotor device taken along line 7B—7B of FIG. 7A.

Of course, it will be appreciated that although the length of the screw rotor device 10 is limited to a single pitch, the pitch length can be changed by altering the helix angle of the threads and grooves. The pitch length increases as the helix angle steepens. The screw rotor device 10 illustrated in FIG. 1 has a pair of threads 34, 36 and a corresponding pair of helical grooves 38, 40 (N=2). Therefore, a single pitch of these rotors would only require a 180° helical twist (360°/2). However, it is evident that the screw rotor device 10, as illustrated in FIG. 1, has a length slightly greater than two pitches. Therefore, for the given length of the rotors, the helix angle for the threads and grooves would have to increase for the rotors to have a single pitch length. For example, FIGS. 7A and 7B illustrate a screw rotor device 10 that has a pair of threads 34, 36 and a corresponding pair of helical grooves 38, 40 that are limited to a 180° helical twist. Accordingly, FIGS. 7A and 7B particularly illustrate rotor lengths that are limited to the single pitch of the threads 34, 36 and grooves 38, 40.

The screw rotor device 10 illustrated in FIG. 7A also incorporates the phase-offset relationship into its design. The angle between ray segment oa and ray segment ob, subtending tooth 42, is arc angle $\alpha$. According to the phase-offset definition provided above, arc angle $\beta$ of the toothless sector 46 must extend from ray segment ob to at least to ray segment oa', which would correspond to twice the arc of arc angle $\alpha$, the minimum phase-offset multiplier being two (2) in equation 1.

As particularly illustrated in FIG. 3, the helical thread 34 preferably has a cut-in convex profile 72 that meshes with the cut-back concave profile 48 of the helical groove 38. The cut-in convex profile 72 has a tooth segment 74 radially extending from minor diameter arc ab. The tooth segment 74 is subtended by arc angle $\alpha$ and is further defined by equation (4) below according to arc angle $\theta$ for minor diameter arc ab.

$$\text{Arc Angle}\alpha > \text{Arc Angle } \theta \quad (4)$$

The phase-offset relationship defined for a pair of threads is also applicable to the male rotor 14 with the single thread 34, such that the toothless sector 46 must have an arc angle $\beta$ that is at least twice the arc angle $\alpha$ of the single helical thread 34. The male rotor 14 circumference is 360°. Therefore, arc angle $\beta$ for the toothless sector 46 must at least 240° and arc angle $\alpha$ can be no greater than 120°. Similarly, for the pair of threads 34, 36, 60° is the maximum arc angle $\alpha$ that could satisfy the minimum phase-offset multiplier of two (2) and 30° is the maximum arc angle $\alpha$ that could satisfy the phase-offset multiplier of five (5) for the preferred embodiment. For practical purposes, it is likely that only large diameter rotors would have a phase-offset multiplier of 50 (3° maximum arc angle $\alpha$) and manufacturing issues may limit higher multipliers.

The male rotor 14 and female rotor 16 each has a respective central shaft 76, 78. The shafts 76, 78 are rotatably mounted within the housing 12 through bearings 80 and seals 82. The male rotor 14 and female rotor 16 are linked to each other through a pair of counter-rotating gears 84, 86 that are respectively attached to the shafts 76, 78. The central shaft 76 of the male rotor 14 has one end extending out of the housing 12. When the screw rotor device 10 operates as a compressor, shaft 76 is rotated causing male rotor 14 to rotate. The male rotor 14 causes the female rotor 16 to counter-rotate through the gears 84, 86, and the helical threads 34, 36 intermesh with the helical grooves 38, 40.

As described above, the distal labyrinth seal 54 helps sealing between each of the helical threads 34, 36 on the male rotor 14 and the cylindrical bore 30 in the housing 12. Similarly, as particularly illustrated in FIG. 3, axial seals 88 may be formed in the housing 12 along the length of the cylindrical bore 32 to help sealing at the periphery of the female rotor 16. As the male rotor 14 and female rotor 16 transition between meshing with each other and respectively sealing around the housing 12, a small gap 90 is formed between the male rotor 14, the female rotor 16 and the housing 12. The rotors 14, 16 fit in the housing 12 with close tolerances.

As discussed above, the preferred embodiment of the screw rotor device 10 is designed to operate as a compressor. The screw rotor device 10 can be also be used as an expander. When acting as an expander, gas having a pressure higher than ambient pressure enters the screw rotor device 10 through the outlet port 20, valve 58 being optional. The pressure of the gas forces rotation of the male rotor 14 and the female rotor 16. As the gas expands into the spaces 39, 41, work is extracted through the end of shaft 76 that extends out of the housing 12. The pressure in the spaces 39, 41 decreases as the gas moves towards the inlet port 18 and exits into ambient pressure at the inlet port 18. The screw rotor device 10 can operate with a gaseous working fluid and may also be used as a pump for a liquid working fluid. For pumping liquids, a valve may also be used to prevent the fluid from backing into the rotor.

Figure 6A:
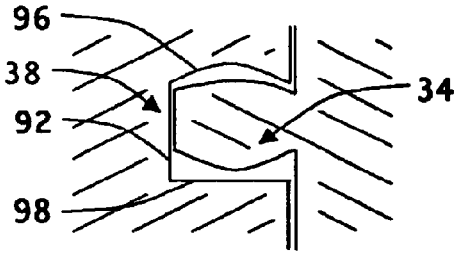
FIG. 6A illustrates a detailed cross-sectional view of the screw rotor device taken along line 6—6 of FIG. 2A.
Figure 6B:
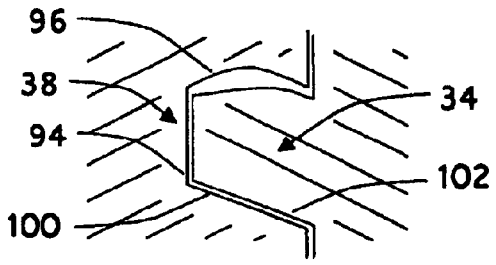
FIG. 6B illustrates a detailed cross-sectional view of the screw rotor device taken along line 6—6 of FIG. 2B.

FIGS. 6A and 6B illustrate a detailed cross-sectional view of the helical grooves and helical threads from FIGS. 2A and 2B, respectively. These views illustrate the differences between an acme thread profile 92 and another feature of the present invention, a buttress thread profile 94. Between the minor diameter 50 and the major diameter 52 of the female rotor, the acme thread profile 92 of the helical groove 38 includes a concave line 96 and a substantially straight line 98 opposite therefrom. The buttress thread profile 94 also includes a concave line 96 but is particularly defined by a diagonal straight line 100. On the male rotor, the acme thread 92 profile of the helical thread 34 is also between the major and minor diameters and includes a pair of opposing convex curves. In comparison, the buttress thread profile 94 has a diagonal straight line 102 that is parallel to and in close tolerance with the corresponding diagonal straight line 100 in the helical groove 38. In the particular example illustrated by FIG. 6B, a convex curve 104 is opposite the diagonal straight line 102.

FIGS. 7A and 7B particularly illustrate the screw rotor device 10 according to several aspects of the present invention, including the parallel diagonal straight lines 100, 102 of the buttress thread profile 94, phase-offset helical threads 34, 36, and the single pitch design of the male and female rotors 14, 16 within the housing 12. With regard to the particular example illustrated by FIG. 7B, the buttress thread profile 94 includes a concave curve 104 opposite from the diagonal straight line 102. It should be appreciated that the benefits of the present invention can be achieved with manufacturing tolerances, such as in the parallel diagonal straight lines 100, 102. In particular, tolerances in the parallel diagonal straight lines 100, 102 may allow for a slight radius of curvature between the diagonal lines and the major and minor diameters and an extremely slight divergence in the parallelism. It will be appreciated that manufacturing tolerances may vary depending on the type of material being used, such as metals, ceramics, plastics, and composites thereof, and depending on the manufacturing process, such as machining, extruding, casting, and combinations thereof.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A screw rotor device for positive displacement of a working fluid, comprising:

a housing having an inlet port at a first end and an outlet port at a second end and a pair of cylindrical bores extending therebetween;

a male rotor having at least one phase-offset helical thread, wherein said male rotor is rotatably mounted about a first axis extending between said first end and said second end of said housing, wherein a cross-section of said phase-offset helical thread, in any plane perpendicular to said first axis, comprises a tooth and a toothless sector, said tooth being subtended by a first arc angle with respect to said axis and said sector having a second arc angle proportionally greater than said first arc angle by a phase-offset multiplier, said tooth having a profile comprising a minor diameter arc and a tooth segment radially extending to a major diameter arc in close tolerance with said housing, and wherein said phase-offset multiplier is at least two for any cross-section taken in any said perpendicular plane; and a female rotor having at least one helical groove, wherein said female rotor is rotatably mounted about a second axis and counter-rotates with respect to said male rotor and has a periphery in close tolerance with said housing, and wherein said helical groove intermeshes with said helical thread.

2. The screw rotor device according to claim 1, wherein said male rotor and said female rotor have a length approximately equal to a single pitch of said helical thread and said helical groove, respectively.

3. The screw rotor device according to claim 1, further comprising a valve in fluid communication with said outlet port, wherein said male rotor and said female rotor each confine the working fluid to a respective space within said housing that is in fluid communication with said outlet port.

4. The screw rotor device according to claim 1, wherein said male rotor further comprises at least one additional helical thread bounding said toothless sector and said female rotor further comprises at least one additional groove intermeshing with said additional helical thread, wherein said male rotor and female rotor have an identical number of helical threads and helical grooves, respectively.

5. The screw rotor device according to claim 4, wherein said phase-offset multiplier is identical for each cross-section taken in any said perpendicular plane.

6. The screw rotor device according to claim 4, wherein said phase-offset multiplier is at least three.

7. The screw rotor device according to claim 4, wherein said phase-offset multiplier is at least four.

8. The screw rotor device according to claim 4, wherein said phase-offset multiplier is at least five.

9. The screw rotor device according to claim 1, wherein said helical groove has a concave profile in a lengthwise cross-section of said female rotor according to a plane extending between said first axis and said second axis, said concave profile radially recessed from a major diameter to a minor diameter of said female rotor and defined between said major diameter and said minor diameter by a concave line and a straight line opposite from said concave line.

10. The screw rotor device according to claim 9, wherein said straight line extends diagonally away from said concave line.

11. The screw rotor device according to claim 10, wherein said helical thread has a convex profile in a lengthwise cross-section of said male rotor according to a plane extending between said first axis and said second axis, said convex profile radially extending from a minor diameter to a major diameter of said male rotor and defined between said minor diameter and said major diameter by a straight diagonal line substantially parallel to said straight line of said female rotor.

12. The screw rotor device according to claim 11, wherein said convex profile further comprises a line selected from the group consisting of a concave line and a convex line.

13. A screw rotor device for positive displacement of a working fluid, comprising:

a housing having an inlet port at a first end and an outlet port at a second end and a pair of cylindrical bores extending therebetween;

a male rotor having at least one phase-offset helical thread and having a length approximately equal to a single pitch of said helical thread, wherein said male rotor is rotatably mounted about a first axis extending between said first end and said second end of said housing, wherein a cross-section of said phase-offset helical thread, in any plane perpendicular to said first axis, comprises a tooth and a toothless sector, said tooth being subtended by a first arc angle with respect to said axis and said sector having a second arc angle proportionally greater than said first arc angle by a phase-offset multiplier, said tooth having a profile comprising a minor diameter arc and a tooth segment radially extending to a major diameter arc in close tolerance with said housing; and a female rotor having at least one helical groove and having a length approximately equal to a single pitch of said helical groove, wherein said female rotor is rotatably mounted about a second axis and counter-rotates with respect to said male rotor and has a periphery in close tolerance with said housing, and wherein said helical groove intermeshes with said helical thread.

14. The screw rotor device according to claim 13, wherein said male rotor and female rotor have an identical number of helical threads and helical grooves, respectively, and wherein said helical threads and helical grooves form a buttress thread shape in a lengthwise cross-section of said male rotor and said female rotor in a plane extending between said first axis and said second axis, wherein said buttress thread shape is comprised of parallel straight diagonal lines and a pair of opposing lines.

15. The screw rotor device according to claim 14, wherein said buttress thread shape is bounded by a first pair of straight lines corresponding with said minor diameter of said male rotor and said major diameter of said female rotor.

16. The screw rotor device according to claim 15, wherein said buttress thread shape is further comprised of a second pair of straight lines corresponding with said major diameter of said male rotor and said minor diameter of said female rotor and located between said parallel straight diagonal lines and said pair of opposing lines.

17. The screw rotor device according to claim 13, wherein said phase-offset multiplier is identical for each cross-section taken in any said perpendicular plane.

18. A screw rotor device for positive displacement of a working fluid, comprising:

a housing having an inlet port at a first end and an outlet port at a second end and a pair of cylindrical bores extending therebetween;

a male rotor having at least one phase-offset helical thread, wherein said male rotor is rotatably mounted about a first axis extending between said first end and said second end of said housing, wherein a cross-section of said phase-offset helical thread, in any plane perpendicular to said first axis, comprises a tooth and a toothless sector, said tooth being subtended by a first arc angle with respect to said axis and said sector having a second arc angle proportionally greater than said first arc angle by a phase-offset multiplier, said tooth having a profile comprising a minor diameter arc and a tooth segment radially extending to a major diameter arc in close tolerance with said housing, and wherein said helical thread forms a first buttress thread shape in a lengthwise cross-section of said male rotor in a plane extending between said first axis and said second axis, wherein said first buttress thread shape is comprised of a first line extending from said minor diameter to said major diameter and a straight line extending diagonally away from said first line; and a female rotor having at least one helical groove, wherein said female rotor is rotatably mounted about a second axis and counter-rotates with respect to said male rotor and has a periphery in close tolerance with said housing, and wherein said helical groove intermeshes with said helical thread and forms a second buttress thread shape in a lengthwise cross-section of said female rotor in a plane extending between said first axis and said second axis, wherein said second buttress thread shape corresponds with said first buttress thread shape and is comprised of a second line extending between a minor diameter and a major diameter of said female rotor and a straight diagonal line extending away from said second line, wherein said straight diagonal line is substantially parallel to said straight line of said male rotor.

19. The screw rotor device according to claim 18, wherein said male rotor and said female rotor have a length approximately equal to a single pitch of said helical thread and said helical groove, respectively.

20. The screw rotor device according to claim 18, wherein said first and second buttress thread shapes are bounded by a first pair of straight lines corresponding with said minor diameter of said male rotor and said major diameter of said female rotor, respectively, and wherein said first and second buttress thread shapes are further comprised of a second pair of straight lines corresponding with said major diameter of said male rotor and said minor diameter of said female rotor, respectively.

* * * * *